United States Patent [19]

Harris

[11] Patent Number: 4,794,355

[45] Date of Patent: Dec. 27, 1988

[54] HEAT SINK FOR MAGNETICALLY TUNED FILTER

[75] Inventor: David L. Harris, Hillsboro, Oreg.

[73] Assignee: Tektronix, Inc., Beaverton, Oreg.

[21] Appl. No.: 91,147

[22] Filed: Aug. 31, 1987

[51] Int. Cl.[4] ..... H01P 7/00; H01P 1/217

[52] U.S. Cl. ..... 333/219; 333/202; 333/235

[58] Field of Search ..... 333/219, 202, 207, 209, 333/235; 336/55, 60, 61

[56] References Cited

U.S. PATENT DOCUMENTS

| | | | |
|---|---|---|---|
| Re. 13,704 | 3/1914 | Rhodes | 336/61 |
| 3,142,809 | 7/1964 | Remenyik | 336/61 |
| 4,506,240 | 3/1985 | Shores et al. | 333/202 |

FOREIGN PATENT DOCUMENTS

| | | | |
|---|---|---|---|
| 0039005 | 3/1983 | Japan | 336/55 |

*Primary Examiner*—Marvin L. Nussbaum
*Attorney, Agent, or Firm*—Francis I. Gray

[57] ABSTRACT

A heat sink for a magnetically tuned filter provides an insulative gap between the magnetic coils and the magnetic housing and pole pieces and has a thermally conductive plate in thermal contact with the magnetic coils with a flange portion extending exterior of the magnetic housing so that heat generated by the magnetic coils is conducted for dissipation external of the magnetic housing. The thermally conductive plate has a central opening in which a filter housing is situated, has a plurality of channels between the central opening and the outer edge to provide for electrical and mechanical access to the filter housing, and has a radial insulative gap from the central opening to the outer edge to prevent the formation of eddy currents in the thermally conductive plate.

8 Claims, 3 Drawing Sheets

HEAT SINK FOR MAGNETICALLY TUNED FILTER

BACKGROUND OF THE INVENTION

The present invention relates to heat sinks, and more particularly to a heat sink for a magnetically tuned very high frequency filter to conduct heat from the interior of a magnetic housing at the point of greatest heat concentration to a point external of the magnetic housing.

Magnetically tuned filters generally have one or more resonant crystal spheres located in respective cavities of a filter housing. The filter housing is enclosed within a magnetic housing with an appropriate maagnetic coil to generate a magnetic field which is used to tune the crystal spheres to a desired frequency. Current magnetically tuned filters use crystal spheres of yttrium-iron-garnet (YIG) which provide a frequency range from about 2 GHz to approximately 21 GHz. Up to these frequencies the heat generated by the current in the magnetic coils does not rise to a level sufficient to require any extraordinary heat dissipation techniques. However, since the power required is a function of the square of the frequency, at frequencies above 21 GHz the heat generated rapidly becomes significant. In fact as the heat rises significantly the resistance of the coils increases, adding to the heat generation so that the heat generated becomes approximately a function of the cube of the frequency. For example at a 40 GHz frequency the temperatures can reach 200° C. depending upon the gap between the pole pieces.

The frequency of the resonant crystal spheres is sensitive to the field strength of the generated magnetic field. The field strength depends on the current in the magnetic coils and the gap between the pole pieces. In many applications, such as in spectrum analyzers, the magnetically tuned filter is subjected to cyclical operation, i.e., the frequency is swept across the range continuously as often as one thousand times per second. This provides a concomitant thermal cycle in the pole pieces which causes expansion and contraction so that the gap between the pole pieces and the crystal spheres varies. The resulting frequency output, therefore, is unpredictable unless the heat can be dissipated so that the gap remains relatively constant.

Attempts to dissipate this heat have been made by placing the magnetic housing upon an external heat sink so that the heat is conducted through the magnetic housing to the heat sink. This is unsatisfactory since the magnetic housing is generally a poor thermal conductor and the maximum heat is concentrated by the coils at the center of the magnetic housing adjacent to the pole pieces. Another approach is to try to maintain a thermal equilibrium between the pole pieces and the outer portion of the magnetic cup by short circuiting the pole pieces to the magnetic housing with an aluminum plate. This approach does not dissipate the heat, but does provide thermal equilibrium so that the tolerance changes in the gap can be determined and compensated to a certain extent.

What is desired is a heat sink for a magnetically tuned filter operation above 21 GHz which dissipates the heat generated by the magnetic coils while maintaining thermal equilibrium within the magnetic housing.

SUMMARY OF THE INVENTION

Accordingly the present invention provides a heat sink for a magnetically tuned filter by providing an insulative gap between the magnetic coils and the magnetic housing, and by providing a thermally conductive plate in thermal contact with the magnetic coils and extending external to the magnetic housing for connection to an external heat sink. The thermally conductive plate has a central opening in which the filter housing for the resonant crystal spheres is situated. The plate has radial channels to provide for external electrical connection to the filter housing and for tuning of the spheres within the filter housing from the edge of the plate. A dielectric gap is provided in the plate to prevent the generation of eddy currents which would act in opposition to the applied magnetic field. The heat from the magnetic coils is conducted from the center of the magnetic housing to the external heat sink via the thermally conductive plate.

The objects, advantages and other novel features of the present invention will be apparent from the following detailed description when read in conjunction with the appended claims and attached drawing.

DESCRIPTION OF THE PREFERRED EMBODIMENT

Figure 1:
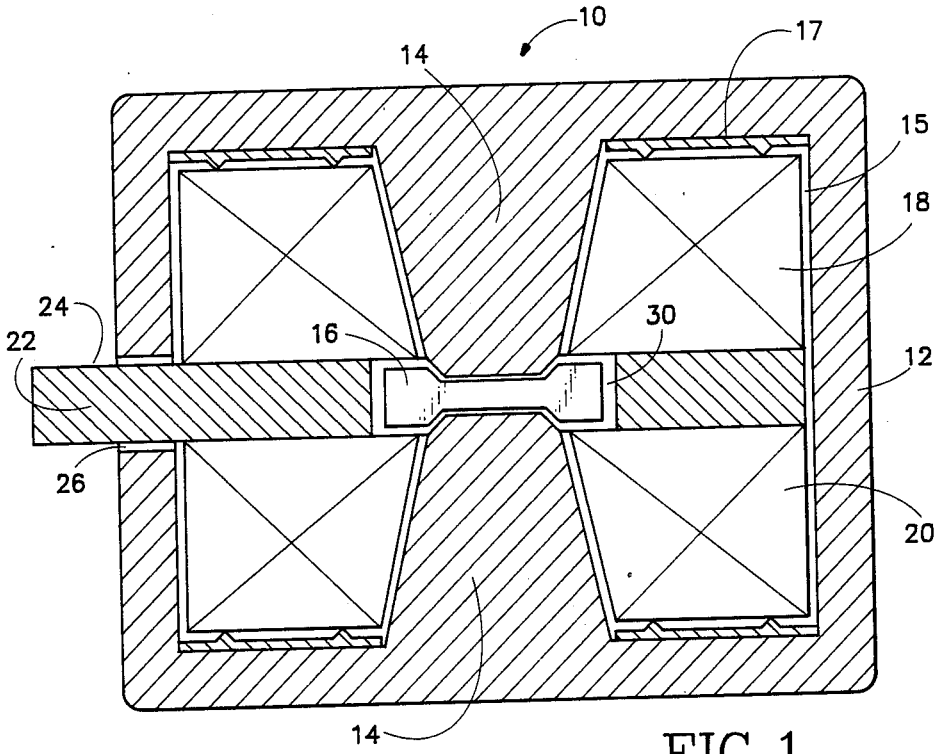
FIG. 1 is a cross-sectional view of a magnetically tuned filter incorporating a heat sink according to the present invention.

Referring now to FIG. 1 a magnetically tuned filter 10 is shown having a magnetic housing 12 with central pole pieces 14 extending from opposite sides toward the center. Held between the pole pieces 14 is a filter housing 16 containing crystal spheres of the type that exhibit an electronic resonance at microwave frequencies when placed in a strong magnetic field, the frequency being directly related to the strength of the magnetic field. Other ferrite crystals besides YIG which are suitable for these applications are lithium-aluminum-ferrite (LAF), nickel-zinc-ferite (NZF) and barium-ferrite (BAF). To provide the necessary magnetic field a pair of coils 18, 20 are wound around the respective pole pieces 14 to complete the electromagnetic circuit, capable of generating flux densities of at least 15 kilogauss. The coils 18, 20 are thermally isolated from the magnetic housing 12 and pole pieces 14 by an insulative gap 15 such as an air gap. A thermally insulative support ring 17 or other such structure may be provided within the insulative gap 15 to assure the spacing between the coils 18, 20 and the magnetic housing 12. Between the coils 18, 20 and thermally attached thereto, and surrounding the filter housing 16, is a thermally conductive plate 22 of a material, such as aluminum or the like, which has a flange portion 24 that extends exterior of the magnetic housing 12 via appropriate openings 26. The flange portion 24 may be thermally attached to other conventional heat dissipating devices, such as cooling fins or thermally conductive blocks external of the magnetic housing 12. The thermally conductive plate 22 is preferably made in two symmetrical halves for ease of manufacture and assembly, and the magnetic housing 12 is preferably in the form of two approximately symmetrical magnetic cups.

Figure 2:
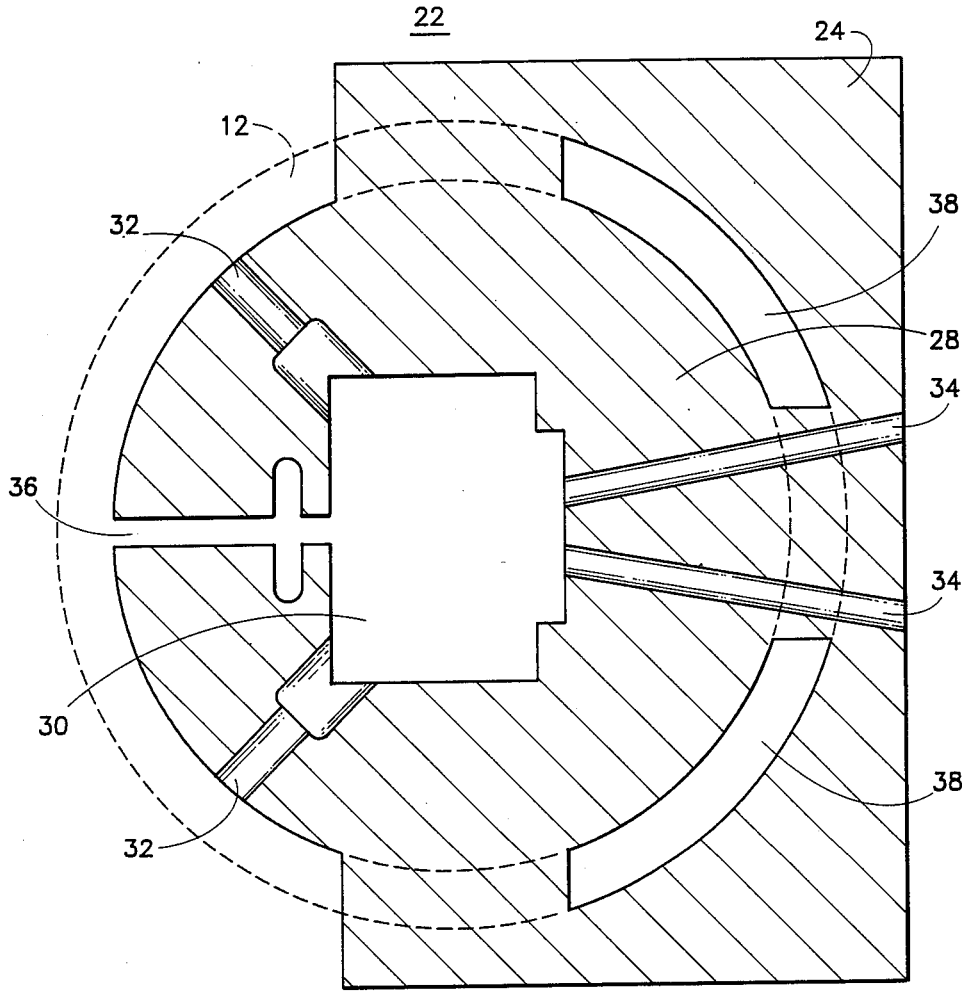
FIG. 2 is a cross-sectional plan view of a thermally conductive plate for use as the heat sink in FIG. 1.
Figure 3:
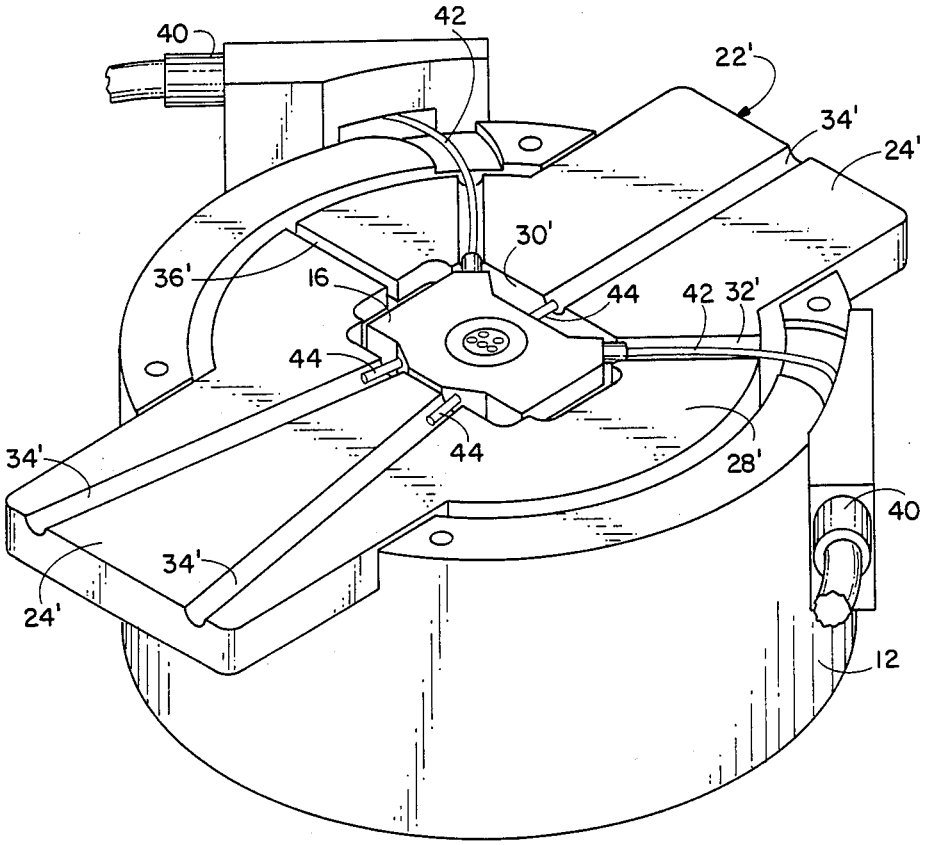
FIG. 3 is a perspective view of another embodiment of the heat sink in a magnetically tuned filter with the top magnetic cup and coil removed.

One embodiment of the thermally conductive plate 22 is shown in FIG. 2. The plate 22 has an essentially round body portion 28 having a diameter slightly less than the interior diameter of the magnetic housing 12. The flange portion 24 is contiguous with the body portion 28. The plate 22 has a cental opening 30 within which the filter housing 16 is situated. A pair of conductor channels 32 extend radially from the edge of the body portion 28 to the central opening 30 to provide for electrical connection of the filter housing 16 with an external coaxial cable. Likewise tuning channels 34 are provided radially from the edge of the body portion 28 to the central opening 30 to provide for the intrusion of adjusting tools from the exterior of the magnetic housing 12 to adjust the crystal spheres within the filter housing 16. Finally an insulative plate gap 36, typically an air gap, is provided radially from the edge of the body portion 28 to the central opening 30 to prevent the formation of eddy currents in the plate 22, since generally the material of the plate is a good electrical conductor as well as a good thermal conductor. The insulative plate gap 36 may also be used as an access to adjust one of the crystal spheres. Concentric slots 38 in the flange portion 24 contiguous to the body portion 28 allows corresponding portions of the magnetic housing 12 to protrude to help secure the plate 22 within the housing in a correct relationship with respect to the connectors and adjustment screws of the filter housing 16.

An alternative configuration of the thermally conductive plate 22' has a body portion 28' and symmetrically opposing flange portions 24' which extend exterior of the magnetic housing 12. In a central opening 30' is situated the filter housing 16 which is electrically connected to exterior coaxial connectors 40 by coaxial cables 42. Adjustment grooves 34' provide access to tuning screws 44 for the crystal spheres within the filter housing 16.

In operation when the current within the coils 18, 20 is increased to provide tuning of the crystal spheres within the filter housing 16 to very high frequencies, on the order of 30–40 GHz or above, heat is concentrated at the center of the coils adjacent the pole pieces 14. This heat is conducted to the thermally conductive plate 22, which in turn conducts the heat external to the magnetic housing 12 for dissipation by conventional cooling fins, thermally conductive blocks or the like. The insulative gap 15 between the magnetic housing 12 and the coils 18, 20 minimizes heating of the magnetic housing and pole pieces 14 since thermal radiation is less efficient than thermal conduction. Thus very little heat variation is introduced to the pole pieces 14 particularly, and the gap between the pole pieces and the crystal spheres within the filter housing 16 is maintained essentially constant. Although prolonged operation at a high frequency causes the magnetic housing 12 and pole pieces 16 to absorb some of the heat, the thermal gradient is gradual and they remain in thermal equilibrium. Any resulting expansion effects can be readily determined and compensated. The insulative plate gap 36 further assures that no eddy currents are set up in the plate 22 which would act against the magnetic field generated by the magnetic coils 18, 20.

Thus the present invention provides a heat sink for a magnetically tuned filter which is in thermal contact with the hottest portion of the magnetic coils and conducts the heat generated due to the high currents necessary to tune to very high frequencies external to the magnetic housing to minimize dimensional changes at the gap between the pole pieces and the crystal resonance spheres.

What is claimed is:

1. A heat sink for a magnetically tuned filter of the type having a magnetic housing with pole pieces extending from opposite sides toward a central location within the magnetic housing and with respective magnetic coils wound around the pole pieces, and having located between the ends of the pole pieces a filter housing containing resonant crystal spheres, comprising means surrounding the filter housing and in thermal contact with the magnetic coils for conducting heat, generated by the magnetic coils when the resonant crystal spheres are tuned to very high frequencies, to a point external of the magnetic housing so that heating of the pole pieces is minimized and thermal equilibrium is maintained within the magnetic housing.

2. A heat sink as recited in claim 1 wherein the conducting means comprises a thermally conductive plate thermally attached to the magnetic coils, the thermally conductive plate having a flange portion extending exterior of the magnetic housing so that heat generated by the magnetic coils is dissipated outside the magnetic housing.

3. A heat sink as recited in claim 2 wherein the thermally conductive plate comprises an essentially circular body portion having a plurality of channels extending radially from a central opening to the edge to provide for electrical connection to the filter housing and for tuning of the crystal spheres, the circular body portion being contiguous with the flange portion, the thermally conductive plate further having an insulative gap extending radially from the central opening to the edge to prevent the formation of eddy currents in the thermally conductive plate.

4. A heat sink as recited in claim 3 wherein the thermally conductive plate further has means for retaining and registering the thermally conductive plate with respect to the magnetic housing and the filter housing.

5. A heat sink as recited in claim 1 further comprising means for thermally insulating the magnetic coils from the magnetic housing and pole pieces.

6. A heat sink as recited in claim 5 wherein the thermally insulating means comprises an insulative support between the magnetic housing and the magnetic coils to provide an air gap therebetween and between the pole pieces and the magnetic coils.

7. A heat sink comprising a thermally conductive plate having a body portion and a contiguous flange portion, the body portion having a central opening, a plurality of channels to the central opening from the edge of the body portion, and a gap from the edge of the body portion to the central opening such that when the body portion contacts a heat source, heat from the heat source is conducted by the body portion to the flange portion for dissipation.

8. A heat sink as recited in claim 7 wherein the thermally conductive plate further comprises a slot at the juncture of the body portion and the flange portion.

* * * * *